United States Patent [19]

Brooks, Jr.

[11] 4,433,796

[45] Feb. 28, 1984

[54] FRAGRANCE OR THE LIKE DISPENSER, PARTICULARLY FOR AUTOMOBILES

[76] Inventor: Kenneth E. Brooks, Jr., 5047 Dry Well Ct., Columbia, Md. 21045

[21] Appl. No.: 290,719

[22] Filed: Aug. 6, 1981

[51] Int. Cl.[3] ..... B67D 5/52

[52] U.S. Cl. ..... 222/135; 222/183; 222/608; 239/305

[58] Field of Search ..... 222/180, 183, 135, 608; 239/305, 282; 239/70, 274, 337, 579

[56] References Cited

U.S. PATENT DOCUMENTS

| | | | |
|---|---|---|---|
| 2,821,436 | 1/1958 | Wenner | 239/274 |
| 3,269,605 | 8/1966 | Silver | 239/305 |
| 3,644,086 | 2/1972 | O'Dell | 239/274 |
| 3,653,554 | 4/1972 | Turben | 239/305 |
| 4,019,658 | 4/1977 | Consaul | 239/305 |
| 4,027,822 | 6/1977 | Usher | 239/305 |
| 4,223,812 | 9/1980 | van Lit | 239/282 |

*Primary Examiner*—John J. Love
*Assistant Examiner*—Jon Rastello
*Attorney, Agent, or Firm*—Edward D. C. Bartlett

[57] ABSTRACT

A dispenser for spraying fragrances in an automobile has a housing with a compartment defined therein and a slot-like aperture in the top thereof. Fragrance-filled containers are positioned horizontally in the compartment in parallel side-by-side relationship. Each container has valve means actuatable to dispense a spray of its fragrance from an orifice thereof upwardly through the slot-like aperture. Two spaced apart front walls support members for selectively actuating the valve means to spray a selected fragrance into the atmosphere.

8 Claims, 5 Drawing Figures

FRAGRANCE OR THE LIKE DISPENSER, PARTICULARLY FOR AUTOMOBILES

FIELD OF THE INVENTION

This invention relates to dispensers for dispensing fragrances or the like, and is particularly for use in automobiles or the like.

BACKGROUND OF THE INVENTION

Spray containers for projecting fine sprays of scent, cologne, deodorant, etc. are well-known. These are usually provided with valve means having a depressable cap or plunger which when depressed by an operator's finger causes a fine spray to be projected from a small orifice in the valve means. These spray containers can be in different forms, for example, aerosol type in which a propellant is mixed with the contents to be sprayed, pump actuated type in which a series of actuations or depressions of the valve means effects a pumping action to eject the contents in a series of sprays, partitioned type in which the contents are contained within an inner flexible bag or liner and the propellant exerts pressure on the outside of the bag or liner. These spray containers have to be held in the hand to be operated and to direct the spray, for example, in the case of a cologne the spray is directed onto a person, whereas in the case of a space deodorant the spray is directed into the air. The expression fragrance or the like as used herein includes any substance which when sprayed into the air creates a pleasant smell, or a distinctive odor, or acts as a deodorant, or acts to cleanse or purify the air.

SUMMARY OF THE INVENTION

It is an object of the present invention to enable fragrances or the like to be sprayed into the air from a spray container without the need to hold the container.

It is yet another object of the invention to provide a manner of treating the air in an automobile, particularly to render such air pleasant-smelling.

Towards the accomplishment of the aforementioned objects and others which will become apparent from the following description and accompanying drawings, there is disclosed a dispenser comprising a housing having a compartment defined therein and aperture means in the top thereof. At least two containers are supported and positioned in the compartment, each container having a fragrance or the like therein and having valve means actuatable to dispense the fragrance from an orifice of the valve means. Each orifice is directed upwardly below and in register with the aperture means. Means, supported by the housing, is provided for selectively actuating any one of the valve means to cause a spray of the selected fragrance to discharge into the air or atmosphere upwardly through the aperture means.

Preferably, the containers are elongated and supported substantially horizontal in parallel side-by-side relationship.

The aperture means preferably comprises a horizontally disposed slot extending at right angles to the lengthwise directions of the elongated containers. The actuating means may comprise at least two pushbuttons or similar such devices, one associated with each container. The pushbuttons may be movable in directions parallel to the lengthwise directions of the elongated containers, and the actuating means may include means for limiting such movement.

According to another aspect of the invention, there is provided a dispenser mounted in an automobile and comprising a housing having a substantially horizontal base, a lid spaced above the base, and a front wall mounted on the base with the upper edge of the front wall being spaced forwardly of the front edge of the lid to define a substantially horizontal aperture between these edges. At least one elongated container is supported substantially horizontally in the housing and has a fragrance therein. The container has valve means actuatable to dispense the fragrance from an orifice of the valve means, the orifice being directed upwardly below and in register with the aperture. A movable actuating member has a part passing through the front wall for actuating the valve means to cause a spray of the fragrance to discharge upwardly through the aperture into the interior of the automobile.

Embodiments of the invention will not be described in detail with reference to the accompanying drawings.

BRIEF DESCRIPTION OF THE DRAWINGS

The FIG. 1 is a top plan view of a dispenser according to the present invention, with some internal parts shown in broken lines.

DESCRIPTION OF THE PREFERRED EMBODIMENTS

Figure 1:
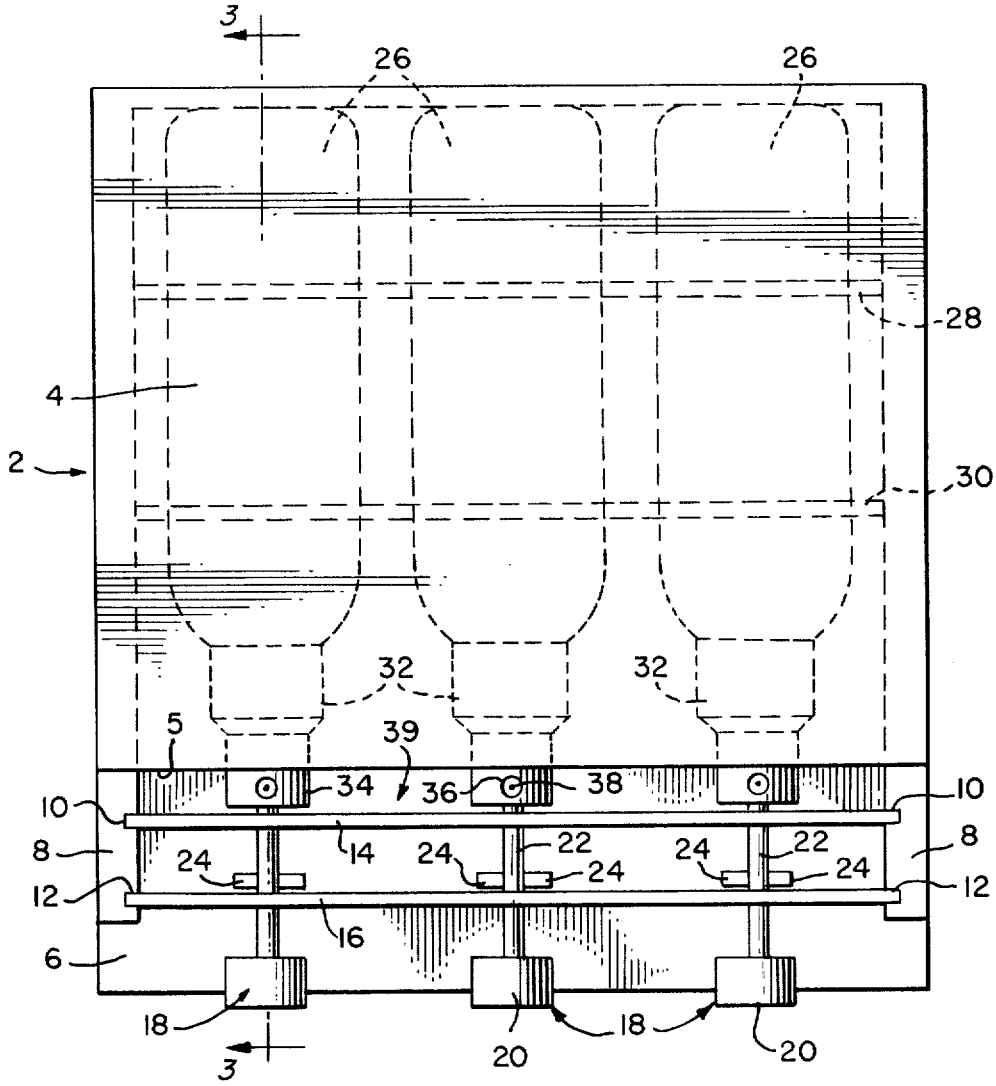

FIG. 1 shows diagrammatically in plan view a dispenser 2 having a flat, almost square, top 4 having a leading edge 5. Below the top 4 is a rectangular base 6 with two side walls 8 connecting the top 4 and the base 6. As can be seen, the top 4 is smaller dimensioned than the base 6; both parts are the same width, but the top 4 is shorter in length than the base 6. Also, as can be seen, the side walls 8 are intermediate in length between the top 4 and the base 6. The portions of the side walls 8 extending beyond the leading edge 5 of the top 4 are provided with pairs of vertically disposed grooves 10,12. An inner front wall 14 is slidably mounted in the two grooves 10, and an outer front wall 16 is slidably mounted in the two grooves 12 in spaced relationship from the inner front wall 14. Three actuating members 18 are supported by the front walls 14 and 16, each actuating member 18 having a pushbutton 20 mounted on a horizontally disposed rod 22 which is slidably engaged in bores through the walls 14 and 16 (shown in FIGS. 3 and 5). A projection 24 is mounted on each side of the rod 22 in the space between the walls 14 and 16 and located adjacent the outer front wall 16; these projections 24 limit the axial movement of the actuating members 18 and retain them in walls 14 and 16. Shown in broken lines are three fragrance-containing aerosol containers 26. Also shown in broken lines, are two internal partitions 28,30 secured to the side walls 8 and having circular openings through which the containers 26 extend. These openings (described more fully later) position and support the containers 26 horizontally in parallel side-by-side relationship. Each container 26, as is well-known, is essentially in the form of an elongated cylinder having a neck portion 32 terminating with a depressable cap 34. The cap 34 has a circular opening 36 in its side wall, with a fine orifice 38 disposed just inside the wall of the cap 34 in a location at approximately the center of the opening 36. The depressable cap 34 and fine orifice 38 are parts of the valve means of the aerosol container and are arranged such that when the cap 34 is slightly depressed a fine spray is ejected through the orifice 38, as is well-known. The front edge 5 of the top 4 and the upper edge of the inner front wall 14 define a horizontally extending slot-like aperture 39. The containers 26 are so oriented that each orifice 38 is directed upwardly and in register with the aperture 39.

Figure 2:
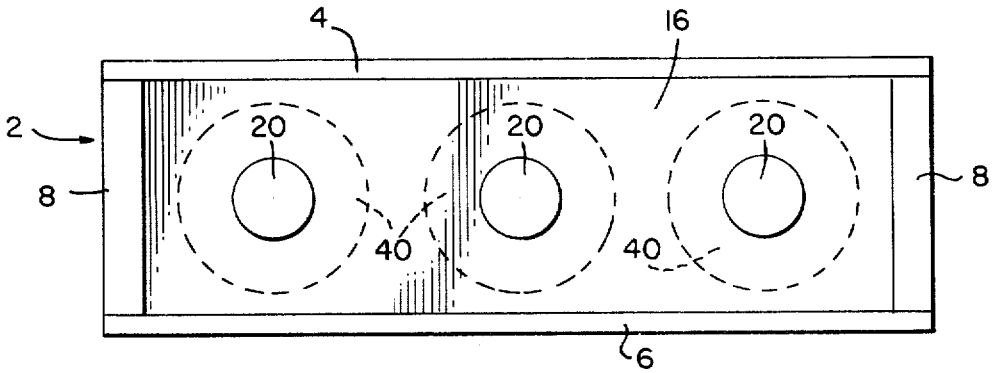
FIG. 2 is an elevational view of the front of the dispenser of FIG. 1.

FIG. 2 is a diagrammatic front elevational view of the dispenser 2 and shows the disposition of the pushbuttons 20. In broken lines are shown the openings 40 through the transverse internal partitions 28,30, and through which openings 40 the containers 26 are disposed.

Figure 3:
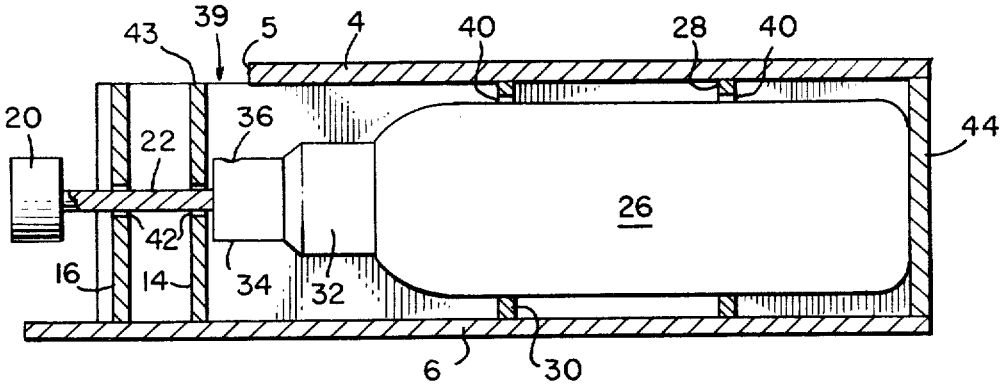
FIG. 3 is a vertical section on the line 3—3 in FIG. 1 with a container not shown in section.

FIG. 3 shows the bores 42 through the front walls 16,14 with the rod 22 slidably engaged therein. The inner end of the rod 22 abuts the center of the cap 34 the opening 36 of which can be seen pointed upwardly below and in register with the slot-like aperture 39 defined between the leading edge 5 of the top 4 and the upper edge 43 of the inner front wall 14. The base of the container 26 abuts the back wall 44, and the container 26 can be seen disposed through the openings 40 in the internal partitions 28,30.

Figure 4:
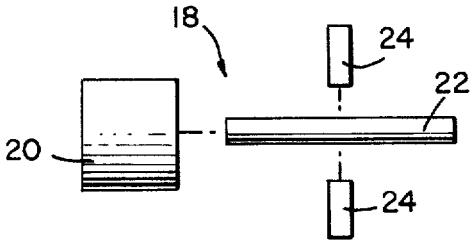
FIG. 4 is an exploded plan view of the parts that make a component of the dispenser of FIG. 1.

FIG. 4 shows an actuating member 18 with its four components in exploded disposition before assembly. During assembly, the pushbutton 20 is first secured to one end of the rod 22 by acrylic cement. The other end of the rod 22 is then inserted through one of the bores 42 in the outer front wall 16. Next the two projections 24 are attached on opposite sides of the rod 22 again using acrylic cement.

To assemble the complete dispenser the three rods 22 with pushbuttons 20 attached are inserted through the outer front wall 16 and the projections 24 attached as described above. Then the inner front wall 14 is engaged over the rods 22 with the free ends of the rods 22 extending through and a short distance beyond the bores 42 to form the front assembly of the dispenser. The base 6, side walls 8, top 4, and internal partitions 28,30 are all secured together with acrylic cement. The three containers 26 are then inserted in position, and finally the front assembly is attached by sliding the ends of the walls 14,16 downwardly in the pairs of grooves 10,12. To replace one or more of the containers 26, the front assembly is slidably withdrawn upwards. The dimensions of this particular embodiment are width 5¼ inches, height 1¾ inches, length of base 5¾ inches, length of side walls 5⅜ inches, length of top 4⅜ inches, width of slot-like aperture 39 5/16 inch.

In use, the dispenser is positioned on top of the dashboard of an automobile or on top of a console unit between the front seats of an automobile. The dispenser should be secured in place and any suitable securing means can be employed; preferably, adhesive strips are secured to the underside of the base 6 and then adhered to the top of the dashboard or console. The three containers 26 would be chosen with different fragrances such as, for example, rose, strawberry, and cherry, respectively. Whenever it is desired to have a particular fragrance in the automobile, particularly if there are any unpleasant odors present, the pushbutton 20 for the fragrance selected is lightly depressed causing a fine spray of that fragrance to pass upwardly through the aperture 39 into the upper part of the interior of the automobile.

Figure 5:
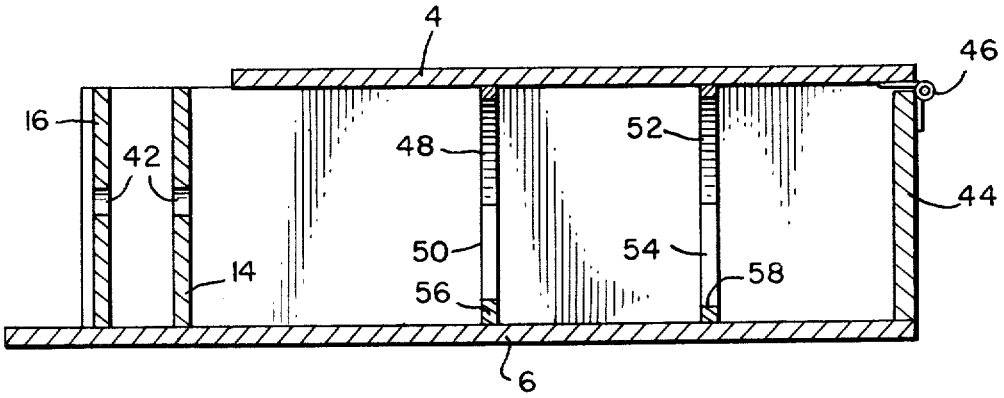
FIG. 5 is a vertical section similar to FIG. 3 of another embodiment of a dispenser according to the present invention, some parts being omitted for clarity.

FIG. 5 is a section similar to FIG. 3 of another embodiment of the dispenser with the container 26 and actuating member 18 omitted for clarity. This embodiment is similar to that described with reference to FIGS. 1 through 4 except for three features. Firstly, the top 4 is attached to the back wall 44 by a piano-type hinge 46 allowing the lid 4 to be pivoted upwardly to replace containers 26. To facilitate this the two internal partitions are formed in two halves with the upper halves 48,52 being attached by acrylic cement to the top 4, and the lower halves 50,54 being attached by acrylic cement to the base 6. Secondly, the ends of the front walls 14 and 16 are attached by acrylic cement to the side walls 8 to render the front assembly non-removable. Thirdly, the circular opening through the internal partition 48,50 is at a slightly higher height than the circular opening through the internal partition 52,54, in other words, the lowest part 56 of the opening through the partition part 50 is at a slightly higher level than the lowest part 58 of the opening through the partition part 54. With this arrangement, when a container 26 is located in position it will be tilted slightly upwards towards the end, having the valve means, adjacent the inner front wall 14. When the dispenser is supported on a horizontal surface, this helps retain the base of the container 26 firmly against the back wall 44.

The above described embodiments, of course, are not to be construed as limiting the breadth of the present invention. Modifications, and other alternative constructions, will be apparent which are within the spirit and scope of the invention as defined in the appended claims.

For example, the dispenser can be used in a room in a building, particularly a bathroom. Further, instead of being an accessory, it could be built-in; for example, it could be built-in into the dashboard of an automobile during the manufacture of the latter.

The structural components of the dispenser are preferably made of plexiglass which can be transparent, semitransparent, opaque, or colored, and the acrylic cement is preferably transparent. However, wood, metal or other material can be employed.

In the embodiment of FIG. 5, the hinge 46 could be disposed along the top of one of the side walls, or could be disposed in the base adjacent the inner front wall 14.

Further, felt or sponge gaskets or grommets can be used to line the openings 40 in the internal partitions so as to restrain the containers 26 from any unwanted movement and help ensure that the orifices 38 remain correctly directed through the aperture 39.

The shape of the dispenser can be chosen for any desired aesthetic effect; instead of being in the form of a rectangular box as shown, it can, for example, be in the form of a cube, a tube, or a pyramid.

It will be appreciated that the present invention provides a dispenser for safely housing one or more spray containers in an automobile in a manner that enables a spray to be emitted conveniently by either the driver or a passenger; further, it will be appreciated that when the dispenser is actuated, either intentionally or accidentally, the spray will not be directed at any of the automobile's occupants, particularly the driver.

What is claimed is:

1. A dispenser mounted in an automobile, and comprising:

a housing having a base secured substantially horizontally in the automobile, a lid spaced above said base, and a front wall mounted on said base with the upper edge of said front wall being spaced forwardly of the front edge of said lid to define a substantially horizontal aperture between said edges;

at least one elongated container supported substantially horizontally in said housing and having a fragrance therein;

said container having valve means depressable in the lengthwise direction of said container to dispense said fragrance from an orifice of said valve means, said orifice being directed upwardly below and in register with said aperture;

a movable actuating member having a part passing through said front wall, said part being movable in said lengthwise direction towards said container to depress said valve means to cause a spray of said fragrance to discharge upwardly through said aperture into the interior of said automobile; and said housing having a second front wall spaced from said first mentioned front wall, and said movable actuating member passing through said second front wall.

2. The dispenser recited in claim 1, further comprising limiting means, disposed between said two front walls, for limiting movement of said actuating member.

3. The dispenser recited in claim 1, wherein there is at least a second said container, said two containers being supported in parallel side-by-side relationship; and further comprising a second movable actuating member having a part passing through said front wall for actuating the valve means of said second container, the two actuating members being spaced apart and each having a pushbutton for individual manual operation thereof; and wherein said compartment has a partition extending transversely to the lengthwise directions of said containers, said partition has openings therein, said containers are located through said openings, said top comprises a hinged lid to provide access to said containers for their replacement, and said partition comprises two sections one of which is attached to said lid and movable therewith and the other of which is attached to said base.

4. A dispenser, comprising:

a housing having a compartment defined therein and aperture means in the top thereof;

at least two containers supported and positioned in said compartment, each container having a fragrance or the like therein and having valve means actuatable to dispense said fragrance from an orifice of said valve means;

each said orifice being directed upwardly below and in register with said aperture means;

means, supported by said housing, for selectively actuating any one of said valve means to cause a spray of the selected fragrance to discharge into the atmosphere upwardly through said aperture means;

said containers being elongated and supported substantially horizontally in parallel side-by-side relationship;

said aperture means comprising a horizontally disposed slot extending at right angles to the lengthwise directions of said elongated containers;

said actuating means comprising at least two pushbuttons, one associated with each said container, said pushbuttons being movable in directions parallel to the lengthwise directions of said elongated containers, and said actuating means including means for limiting such movement;

said compartment having a partition extending transversely to said lengthwise directions of said containers and having openings therein, said containers being located through said openings;

said housing having a hinged lid to provide access to said containers for their replacement, and said partition comprising two sections one of which is attached to said lid; and said housing being box-like having a base, a smaller dimensioned lid, side walls substantially parallel to said lengthwise directions of said containers, two parallel spaced apart front walls, each front wall having a bore therethrough for each said pushbutton with said limiting means being disposed between said front walls, and said slot being defined between a front edge of said lid and an upper edge of one of said front walls.

5. The dispenser recited in claim 4, having at least three containers, each containing a different fragrance or the like.

6. A dispenser, comprising:

a housing having a compartment therein defined by a base, a top spaced above the base, and a front wall mounted on the base with the upper edge of the front wall being spaced forwardly of the front edge of the top to define an aperture between said edges;

at least two containers supported and positioned in said compartment, each container having a fragrance or the like therein and having valve means actuatable to dispense said fragrance from an orifice of said valve means;

each said orifice being directed upwardly below and in register with said aperture;

means, supported by said housing, for selectively actuating any one of said valve means to cause a spray of the selected fragrance to discharge into the atmosphere upwardly through said aperture;

said housing having a second front wall spaced apart from and forwardly of said compartment front wall, said actuating means passing through and being movable relative to bores in said second and compartment front walls; and said actuating means including means for limiting movement thereof relative to said bores, said limiting means being disposed between said second and compartment front walls.

7. The dispenser recited in claim 6, wherein said aperture is elongated and extends across the full width of said top, said containers define longitudinal axes, and said aperture is disposed at right angles to said longitudinal axes.

8. The dispenser recited in claim 6, wherein said orifice of each container is spaced a distance below said aperture whereby said spray of the selected fragrance discharges upwardly said distance before passing upwardly through said aperture.

* * * * *